US006889022B2

(12) United States Patent
Ehara et al.

(10) Patent No.: US 6,889,022 B2
(45) Date of Patent: May 3, 2005

(54) ROTATIONALLY PHASE-MATCHED DRIVING DEVICE AND IMAGE FORMING APPARATUS INCLUDING THE SAME

(75) Inventors: Yasuhisa Ehara, Kanagawa (JP); Kohji Amanai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/329,371

(22) Filed: Dec. 27, 2002

(65) Prior Publication Data

US 2003/0152402 A1 Aug. 14, 2003

(30) Foreign Application Priority Data

Dec. 28, 2001 (JP) ..... 2001-399622
Mar. 6, 2002 (JP) ..... 2002-060539
Nov. 26, 2002 (JP) ..... 2002-341682

(51) Int. Cl.[7] ..... G03G 15/00
(52) U.S. Cl. ..... 399/167
(58) Field of Search ..... 399/167, 159, 399/299, 306, 111, 110, 117

(56) References Cited

U.S. PATENT DOCUMENTS

| | | | | |
|---|---|---|---|---|
| 6,070,041 | A | 5/2000 | Nakayasu et al. | |
| 6,173,141 | B1 | 1/2001 | Sakagami et al. | |
| 6,382,094 | B1 * | 5/2002 | Chiba et al. | 101/116 |
| 6,507,720 | B2 | 1/2003 | Kabumoto et al. | 399/258 |

FOREIGN PATENT DOCUMENTS

| | | |
|---|---|---|
| JP | 4-54613 | 2/1992 |
| JP | 6-167858 | 6/1994 |
| JP | 7-31446 | 4/1995 |
| JP | 8-14731 | 2/1996 |
| JP | 8-194361 | 7/1996 |
| JP | 10-20604 | 1/1998 |
| JP | 11-30889 | 2/1999 |
| JP | 2000-35090 | * 2/2000 |
| JP | 2000-89536 | 3/2000 |
| JP | 2000-310297 | * 11/2000 |
| JP | 2000-352851 | 12/2000 |
| JP | 2001-235970 | 8/2001 |
| JP | 2002-62706 | 2/2002 |

OTHER PUBLICATIONS

Patent Abstracts of Japan, JP 61–156160, Jul. 15, 1986.
Patent Abstracts of Japan, JP 62–11965, Jan. 20, 1987.

* cited by examiner

*Primary Examiner*—Quana Grainger
(74) *Attorney, Agent, or Firm*—Oblon, Spivak, McClelland, Maier & Neustadt, P.C.

(57) ABSTRACT

A driving device for driving a plurality of driven members of the present invention includes a first drive source for driving first one of the driven members. A second drive source drives second driven members other than the first drive member. An idler gear intervenes between the second driven members for transmitting the output torque of the second drive source. The second driven members are matched in rotation variation phase to each other during assembly.

26 Claims, 15 Drawing Sheets

ROTATIONALLY PHASE-MATCHED DRIVING DEVICE AND IMAGE FORMING APPARATUS INCLUDING THE SAME

BACKGROUND OF THE INVENTION

1. Field of the Invention

The present invention relates to a copier, printer, facsimile apparatus, multiplex machine or similar image forming apparatus. More particularly, the present invention relates to a driving device included in, e.g., an image forming apparatus for driving a plurality of image carriers or rotary bodies.

2. Description of the Background Art

A driving device of the type transmitting the output torque of a drive source to a driven member via a gear is conventional. It is a common practice with this type of driving device to arrange idler gears in a gear train in order to drive a plurality of driven members with a small number of drive sources.

An image forming apparatus belongs to a family of apparatuses using a plurality of driven members. A color printer or similar image forming apparatus, among others, uses a plurality of photoconductive elements or image carriers for forming a full-color image. One of conventional color printers includes image forming units arranged side by side and each being capable of forming a toner image of a particular color on a respective photoconductive element. In this type of color printer or tandem color printer, toner images formed by the image forming units are sequentially transferred to an intermediate image transfer body one above the other, completing a full-color image on the intermediate image transfer body. The full-color image is then transferred from the intermediate image transfer body to a sheet or similar recording medium. Another type of tandem color printer is constructed to convey a sheet via consecutive image forming units while sequentially transferring toner images formed by the image forming units to the sheet one above the other, thereby forming a full-color image on the sheet.

In the tandem color printer, the photoconductive elements included in the image forming units are rotated in the same direction as each other to transfer toner images to the intermediate image transfer body or the sheet. The photoconductive elements each are assigned to one of four colors, i.e., yellow, cyan, magenta and yellow complementary to separated colors.

The photoconductive elements of the image forming units each may be driven by a respective drive source or may share a single drive source, as well known in the art. In a drive system using a single drive source, a gear is mounted on the shaft of one photoconductive element, which is directly driven by the drive source, while an idle gear is held in mesh with the gear, so that the rotation of the one photoconductive element is transferred to the other photoconductive elements via the driven gear and idle gear. A problem with this type of drive system is that any eccentricity or irregularity in diameter of each photoconductive element, driven gear, drive gear or idler gear causes the rotation speed of the photoconductive element to noticeably vary, resulting in banding or image shift. Although this problem may be solved by a scheme capable of reducing eccentricity or irregularity in diameter, such a scheme makes production difficult and increases cost.

To reduce the mutual influence of the irregular rotations of the photoconductive elements, Japanese Patent No. 3,107, 259, for example, discloses a drive system in which a rotary encoder is mounted on a shaft driven by a motor for driving a photoconductive element. Feedback control or feedforward control is executed with the motor in accordance with a phase signal output from the rotary encoder such that the rotation phases of the photoconductive elements are matched to each other. Also, Japanese Patent Laid-Open Publication No. 6-167858, for example, teaches a system in which the reduction ratio of idle gears intervening between photoconductive elements is increased to obstruct the transfer of a phase shift from one photoconductive element to the next photoconductive element.

However, U.S. Pat. No. 3,107,259 mentioned above has a problem that an exclusive drive source must be assigned to each photoconductive element, and moreover arrangements for monitoring the rotation speed of the individual drive source is essential. In addition, all the photoconductive elements must be driven not only in a full-color mode but also in a monochrome mode, increasing parts cost and aggravating power consumption.

The problem with Laid-Open Publication No. 6-167858 also mentioned above is that the frequency of rotation variation must be increased because the rotation speed variation of each photoconductive element is effected by amplitude. While the frequency of rotation variation may be increased if the rotation speed of the output gear of the motor or drive source is noticeably increased, the increased frequency effects not only the photoconductive drums but also speed control over a sheet conveying system and image transferring mechanisms. Consequently, a period of time long enough for image formation is difficult to achieve, lowering the productivity of prints.

More specifically, as for the productivity of prints, assume that the rotation speed of the driveline is increased for the purpose of obviating irregularity in rotation between the photoconductive elements. Then, it is necessary to increase the operation speed of image transfer mechanisms for transfer ring toner images from the photoconductive elements and the operation speed of a sheet conveying system. This is apt to damage a sheet being conveyed or makes a conveying time necessary for fixation short. As for a fixing time, although a required fixing time may be guaranteed without regard to the increase in the rotation speed of the photoconductive elements, a plurality of conveying speed systems are necessary, one assigned to the time of conveyance via the photoconductive elements and the other assigned to the time of fixation, resulting in sophisticated control. Moreover, the irregularities of the individual gears are multiplied and make it difficult to reduce irregularity in rotation between the photoconductive elements even if the rotation speed is increased. Consequently, irregularity between the gears cannot be obviated unless the gears are machined with utmost accuracy, resulting in an increase in machining cost and therefore in the production cost of the entire apparatus.

Technologies relating to the present invention are also disclosed in, e.g., Japanese Patent Laid-Open Publication Nos. 63-11965 and 4-54613, Japanese Patent Publication Nos. 7-31446, 8-14731, and Japanese Patent Laid-Open Publication Nos. 8-194361 and 2000-352851.

SUMMARY OF THE INVENTION

It is an object of the present invention to provide a driving device for an image forming apparatus capable of reducing the rotation speed variation of a rotary body and obviating banding and positional shift with a simple, low cost configuration.

It is another object of the present invention to provide a driving device for an image forming apparatus capable of obviating the shift of an image transfer position relative to a write position ascribable to the rotation variation of an image carrier, thereby insuring high image quality.

It is another object of the present invention to provide a driving device capable of rotating, during the black-and-white mode of operation of a color image forming apparatus, by way of example, only the black image carrier, thereby obviating wasteful rotation of other image carriers and saving power.

A driving device for driving a plurality of driven members of the present invention includes a first drive source for driving first one of the driven members. A second drive source drives second driven members other than the first drive member. An idler gear intervenes between the second driven members for transmitting the output torque of the second drive source. The second driven members are matched in rotation variation phase to each other during assembly.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
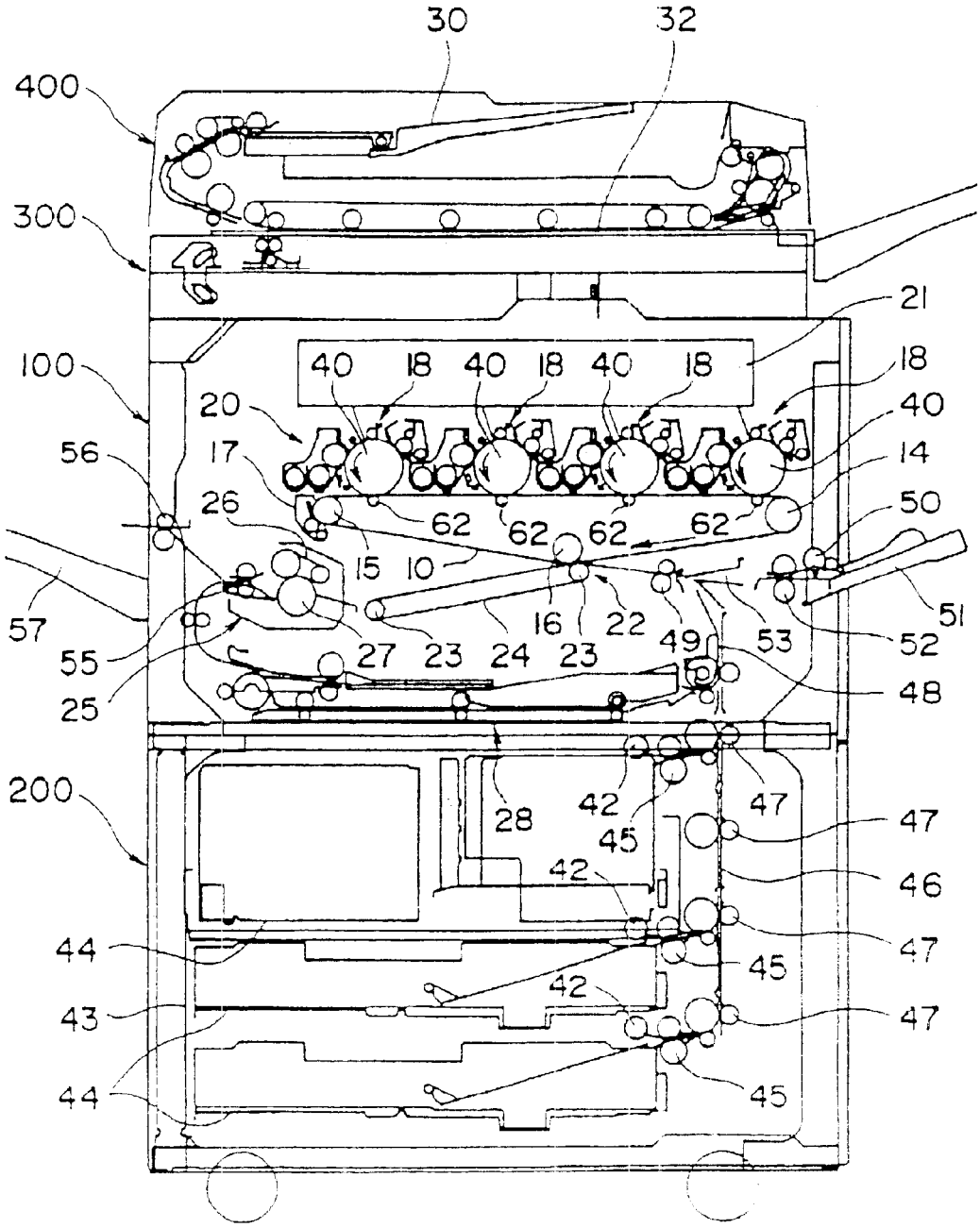
FIG. 1 shows an image forming apparatus embodying the present invention.

Referring to FIG. 1 of the drawings, an image forming apparatus embodying the present invention is shown and implemented as a tandem color copier by way of example. As shown, the color copier is generally made up of a copier body 100, a sheet feed table 200 on which the copier body 100 is mounted, a scanner 300 mounted on the copier body 100, and an ADF (Automatic Document Feeder) 400 mounted on the scanner 300.

In the copier body 100, an intermediate image transfer belt or body (simply belt hereinafter) 10 is positioned at the center and passed over a drive roller 14 and a first and a second driven roller 15 and 16. The belt 10 is movable clockwise as viewed in FIG. 1. Of course, the belt 10 may be passed over four or more rollers including a roller that prevents the belt 10 from being shifted sideways. While the belt 10 is shown as extending substantially horizontally, it may be inclined, if desired.

In the illustrative embodiment, a belt cleaner 17 is positioned at the left-hand side the first driven roller 15, as viewed in FIG. 1, for removing toner left on the belt 10 after image transfer.

A tandem, image forming device 20 is positioned above the upper run of the belt 10 and includes four image forming means 18 arranged side by side in the direction of movement of the belt 10. The four image forming means 18 each are assigned to one of four colors, e.g., black, yellow, magenta, and cyan. An exposing unit 21 is positioned above the image forming device 20.

A secondary image transferring device 22 is positioned below the lower run of the belt 10 and includes a secondary image transfer belt (simply belt hereinafter) 24. The belt 24 is passed over two rollers 23 and pressed against the second driven roller 16 in order to transfer an image from the belt 10 to a sheet or similar recording medium. The sheet may be any one of a plain sheet applicable to, e.g., copying, an OHP (OverHead Projector) film, a card, postcard or similar thick sheet corresponding to 90K and 100 g/m$^2$ or above, and an envelope or similar special sheet greater in thermal capacity than a paper sheet.

A fixing unit 25 is positioned at one side of the secondary image transferring device 22 for fixing an image transferred to the sheet. The fixing unit 25 includes a fixing belt 26 and a press roller 27 pressed against the belt 26. At least part of the fixing unit 22 is positioned below the belt 10.

The secondary image transferring device 22 bifunctions as a conveyor for conveying a sheet with an image to the fixing unit 25. The secondary image transferring device 22 may, of course, be implemented as a non-contact type charger although the charger does not convey a sheet.

A duplex copy unit 28 is positioned below the secondary image transferring device 22 and fixing unit 25 and extends in the same direction as the belt 10. The duplex copy unit 28 reverses a sheet, so that an image can be formed on both sides of the sheet.

A person, intending to copy a desired document image on a sheet, sets the document on a document tray 30 included in the ADF 400 or opens the ADF 400, sets the document on a glass platen 30 included in the scanner 300, and then closes the ADF 400. Subsequently, when the person or operator presses a start switch, not shown, the scanner 300 starts reading the document conveyed from the ADF 400 and then positioned on the glass platen 32 or the document laid on the glass platen 32 by hand.

Also, when the operator presses the start switch, a drive motor, not shown, causes the drive roller 14 to start rotating for thereby moving the belt 10. The belt 10, in turn, causes the driven rollers 15 and 16 to rotate. At the same time, photoconductive drums or image carriers 40 respectively included in the four image forming means 18 are rotated to form a black, a yellow, a magenta and a cyan toner image on the drums 40. While the belt 10 is movement, the toner images of four different colors are sequentially transferred from the drums 40 to the belt 10, completing a full-color image on the belt 10. This image transfer will be referred to as primary image transfer hereinafter.

Further, when the start switch is pressed, one of pickup rollers 42 disposed in the sheet feed table 200 is selected and caused to rotate. The pickup roller 42 in rotation pays out the top sheet from associated one of sheet cassettes 44 positioned one above the other. At this instant, a reverse roller 45 prevents sheets underlying the top sheet from being paid out together with the top sheet. The sheet paid out is introduced into a sheet path 46. Subsequently, roller pairs 47 convey the sheet via a sheet path 48 formed in the copier body 100 until the leading edge of the sheet abuts against the nip of a registration roller pair 49. Alternatively, a pickup roller 50 assigned to a manual feed tray 51 may be rotated to pay out a sheet from the tray 51. This sheet is conveyed via a sheet path 53 until it abuts against the nip of the registration roller pair 49.

The registration roller pair 49 once stops the sheet and then conveys it toward a nip between the belt 10 and the secondary image transferring device 22 in synchronism with the full-color image being conveyed by the belt 10. The secondary image transferring device 22 transfers the full-color image from the belt 10 to the sheet at a time. This image transfer will be referred to as secondary image transfer.

More specifically, at the secondary image transfer station, a bias of, e.g., −800 V to −2,000 V is applied to the reverse side of the sheet while pressure of about 50 $N/cm^2$ is applied to the sheet. An electric field formed by the bias exerts an electrostatic force on the sheet. The electrostatic force and pressure cooperate to attract the toner from the belt 10 toward the sheet.

The secondary image transferring device 22 conveys the sheet carrying the full-color image to the fixing unit 25. After the fixing unit 25 has fixed the image on the sheet with heat and pressure, a path selector 55 steers the sheet toward an outlet roller pair 56. The outlet roller pair 56 drives the sheet out of the printer body 100 to a copy tray 57. The path selector 55 is capable of steering the sheet toward the duplex copy unit 28, as needed. The duplex copy unit 28 reverses the sheet and again feeds it to the image transfer position, so that a toner image can be formed on the reverse side also. This sheet is also driven out to the copy tray 57 by the outlet roller pair 56.

After the image transfer, the belt cleaner 17 removes toner left on the belt 10 to thereby prepare the belt 10 for the next image forming cycle.

Figure 6:
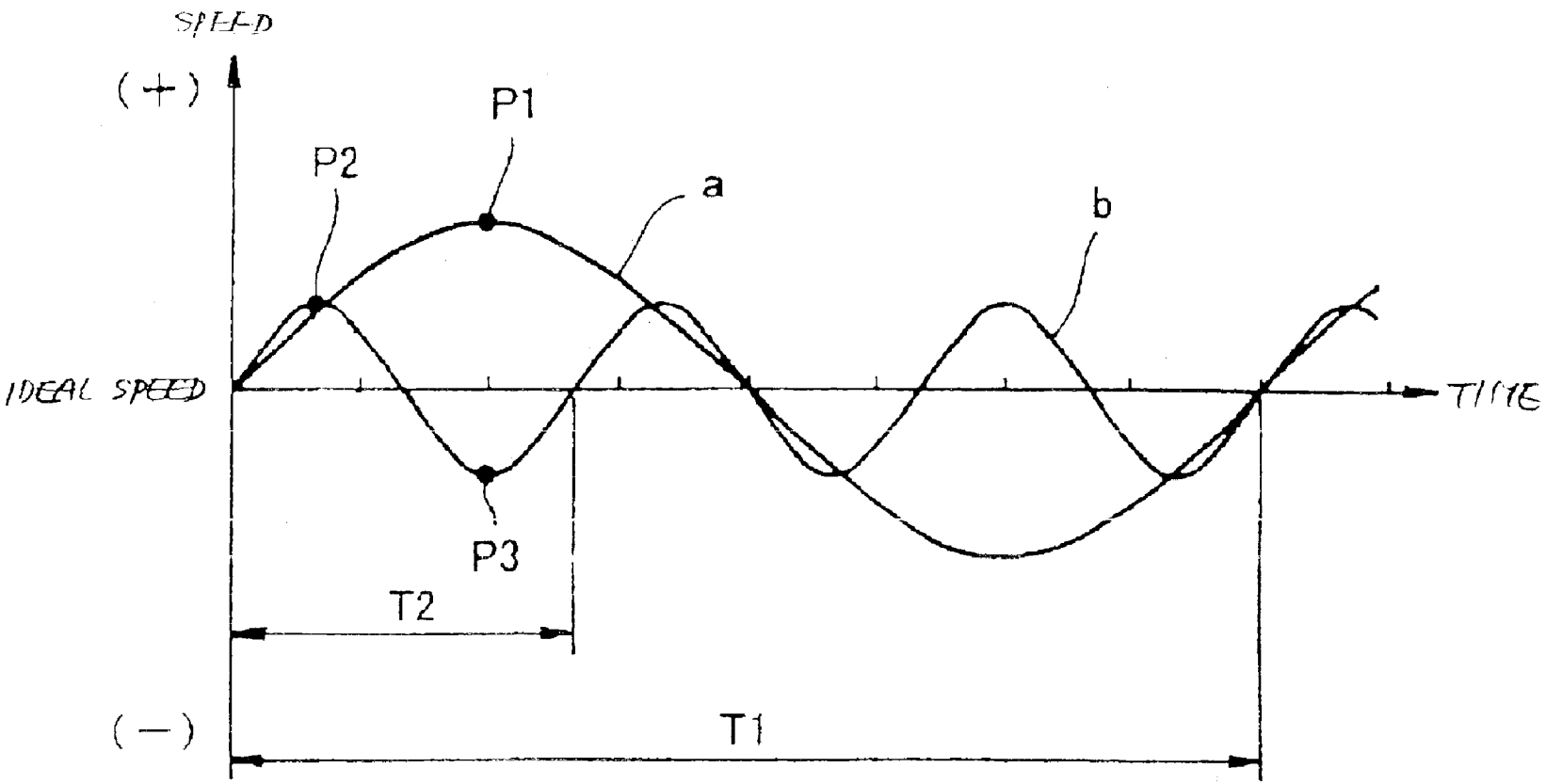
FIG. 6 shows curves similar to the curves of FIG. 5 on the assumption that the frequency of rotation speed variation of the idler gear is three times as high as the frequency rotation speed variation of the motor output shaft.

FIG. 6 shows part of the image forming device 20 in detail. As shown, each image forming means 18 includes a charger 60, a developing unit 61, a primary image transferring device 62, a drum cleaner 63 and a discharger 64 arranged around the drum 40. The entire or part of the image forming means 18 may be constructed into a process cartridge bodily removable from the copier body 100, if desired. In the illustrative embodiment, the charger 60 is implemented as a charge roller and uniformly charges the drum 40 in contact with the drum 40.

In the illustrative embodiment, the developing unit 61 uses a two-ingredient type developer, i.e., a mixture of magnetic carrier grains and nonmagnetic toner grains. The developing unit 61 is made up of an agitating section 66 and a developing section 67 higher in level than the agitating section 66. In the agitating section 66, the developer is conveyed to deposit on a sleeve 65 while being agitated. In the developing section 67, the toner of the developer is transferred from the sleeve 65 to the drum 40.

More specifically, the agitating section 66 accommodates two parallel screws 68 for agitation isolated from each other by a partition 69. A toner content sensor 71 is mounted on a casing 70. In the developing section 67, the sleeve 65 faces the drum 40 via an opening formed in the casing 70. A stationary magnet roller 72 is disposed in the sleeve 65. A doctor blade 73 has an edge adjoining the sleeve 65.

The two screws 68 convey the developer toward the sleeve 65 while agitating it. The magnet roller 72 causes the developer to magnetically deposit on the sleeve 65 in the form of a magnet brush. While the sleeve 65 in rotation conveys the developer deposited thereon, the doctor blade 73 meters the developer and causes it to form a thin layer having preselected thickness. Part of the developer removed by the doctor blade 73 is returned to the agitating section 66.

The developer on the sleeve 65 is transferred to the drum 40 to thereby develop a latent image formed on the drum 40. The developer left on the sleeve 65 after the development is released from the sleeve 65 at a position where the magnetic force of the magnet roller 72 does not act, and returned to the agitating section 66. When the toner content of the developer in the agitating section 66 decreases due to repeated development, fresh toner is replenished to the agitating section 66 in accordance with the output of the toner content sensor 71.

The primary image transferring device 62 is implemented as a roller pressed against the drum 40 via the belt or intermediate image transfer body 10. The roller may, of course, be replaced with a non-contact type charger.

Figure 2:
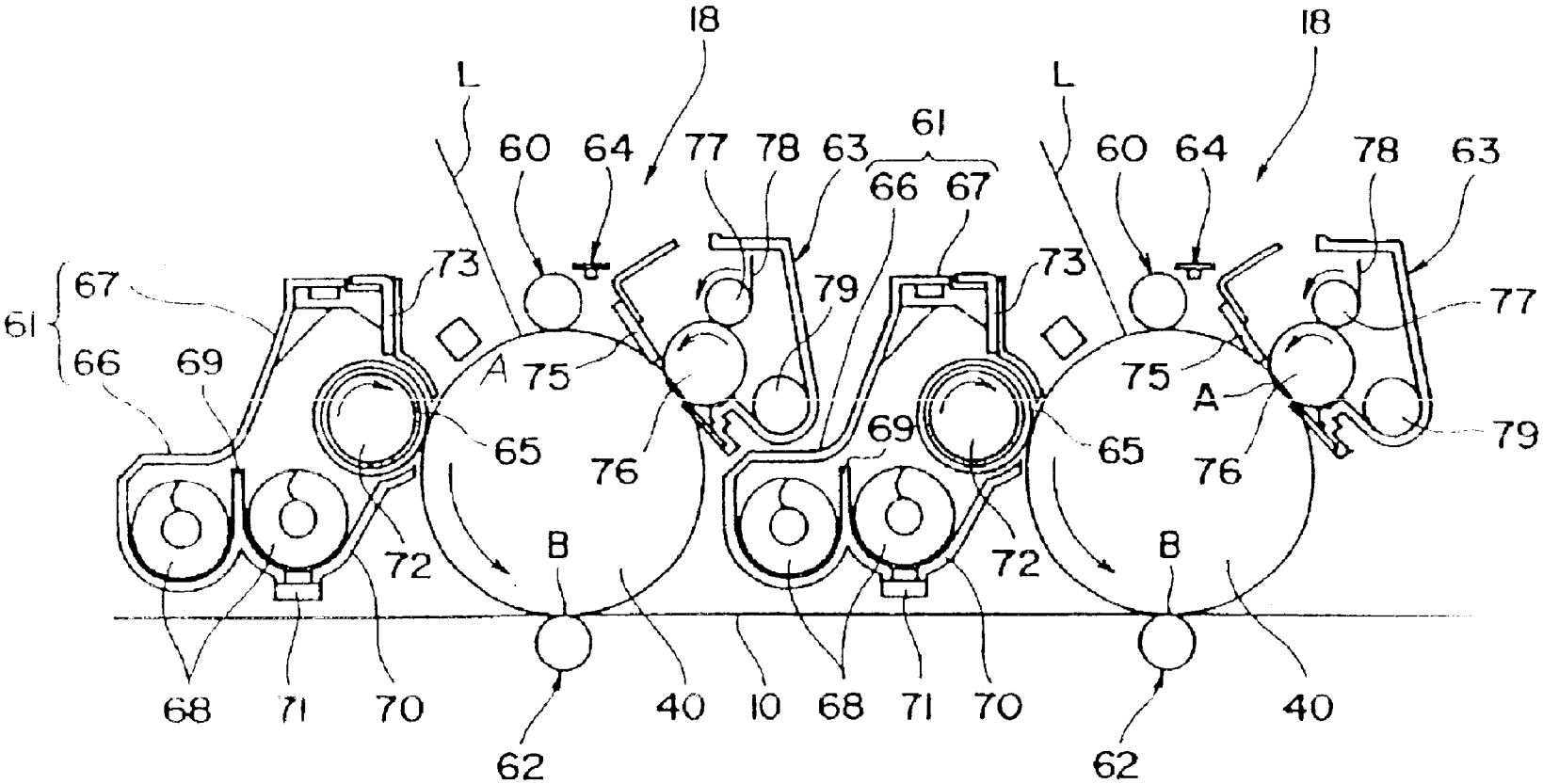
FIG. 2 is an enlarged view showing part of a tandem, image forming device included in the illustrative embodiment.

The drum cleaner 63 includes a cleaning blade 75 formed of, e.g., polyurethane rubber and having an edge contacting the drum 40. A conductive fur brush 76 is held in contact with the drum 40 and rotatable in a direction indicated by an arrow in FIG. 2. A metallic, electric field roller applies a bias to the fur brush 76 and is rotatable in a direction indicated by an arrow in FIG. 2. A scraper 78 has an edge contacting the electric field roller 77. Further, a screw 79 collects the toner removed from the drum 40.

The fur brush 76, which rotates in a direction counter to the drum 40, removes the toner left on the drum 40. The electric field roller 77 applies a bias to the fur brush 76 while rotating in a direction counter to the fur brush 76, thereby removing the toner from the fur brush 76. The scraper 78 cleans the surface of the electric field roller 77. The screw 79 conveys the removed toner to a waste toner bottle, not shown, or returns it to the developing unit 61 for reuse.

The discharger 64 may be implemented as a quenching lamp that illuminates the surface of the drum 40 to thereby initialize the surface potential of the drum 40.

In operation, while the drum 40 is in rotation, the charger 60 uniformly charges the surface of the drum 40.

Subsequently, the exposing device 21 scans the charged surface of the drum 40 with a light beam L issuing from, e.g., a laser or an LED (Light Emitting Diode) array in accordance with image data. As a result, a latent image is electrostatically formed on the drum 40 at a write position A.

Subsequently, the developing unit 61 deposits toner on the latent image to thereby produce a corresponding toner image. The toner image is transferred from the drum 40 to the belt 10 at an image transfer position B by the primary image transferring device 62. After the image transfer, the toner left on the drum 40 is removed by the drum cleaner 63. Thereafter, the discharger 64 discharges the surface of the drum 40 to thereby prepare it for the next image forming cycle.

Figure 3:
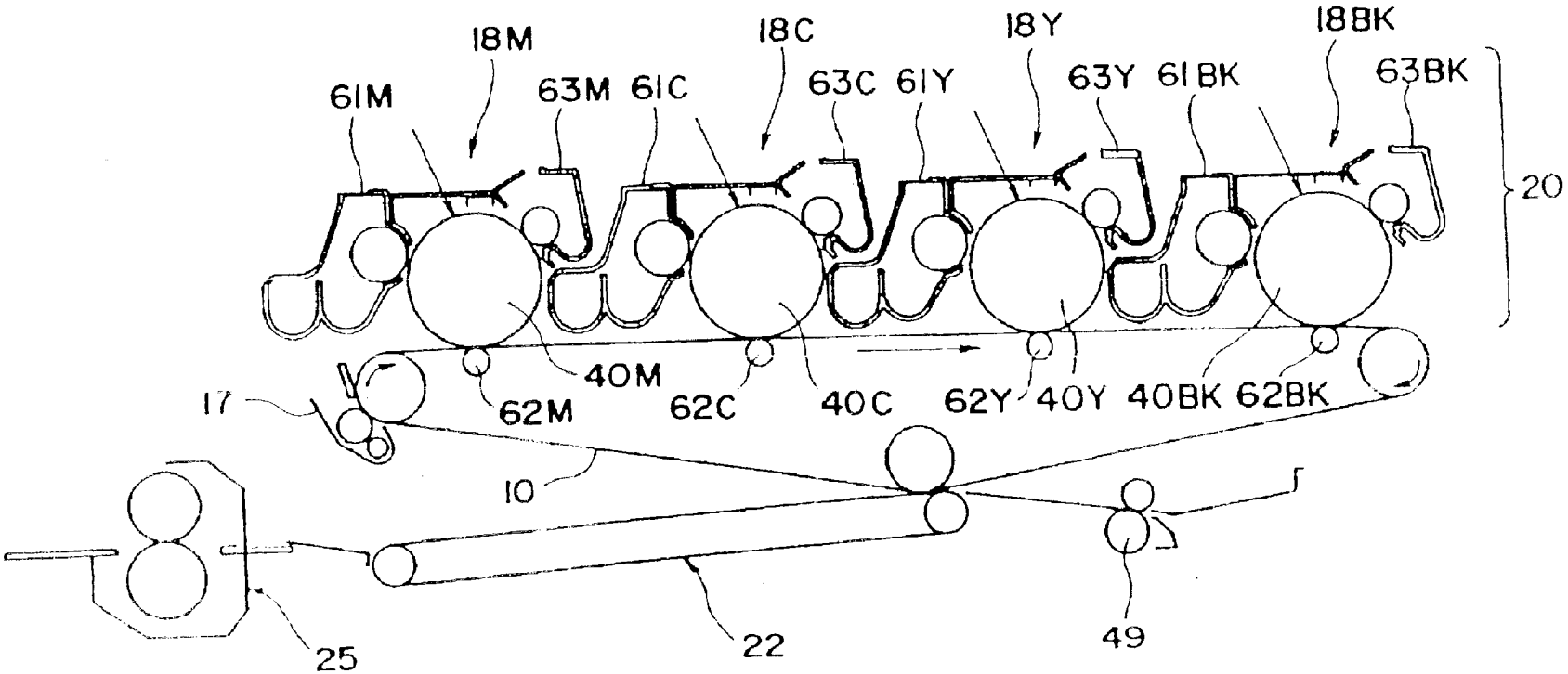
FIG. 3 shows the configuration of the entire image forming device.

FIG. 3 shows the entire image forming device 20 more specifically. As shown, magenta, cyan, yellow and black image forming means 18M, 18C, 18Y and 18BK are sequentially arranged in this order from the upstream side to the downstream side in the direction of movement of the belt 10.

Figure 4:
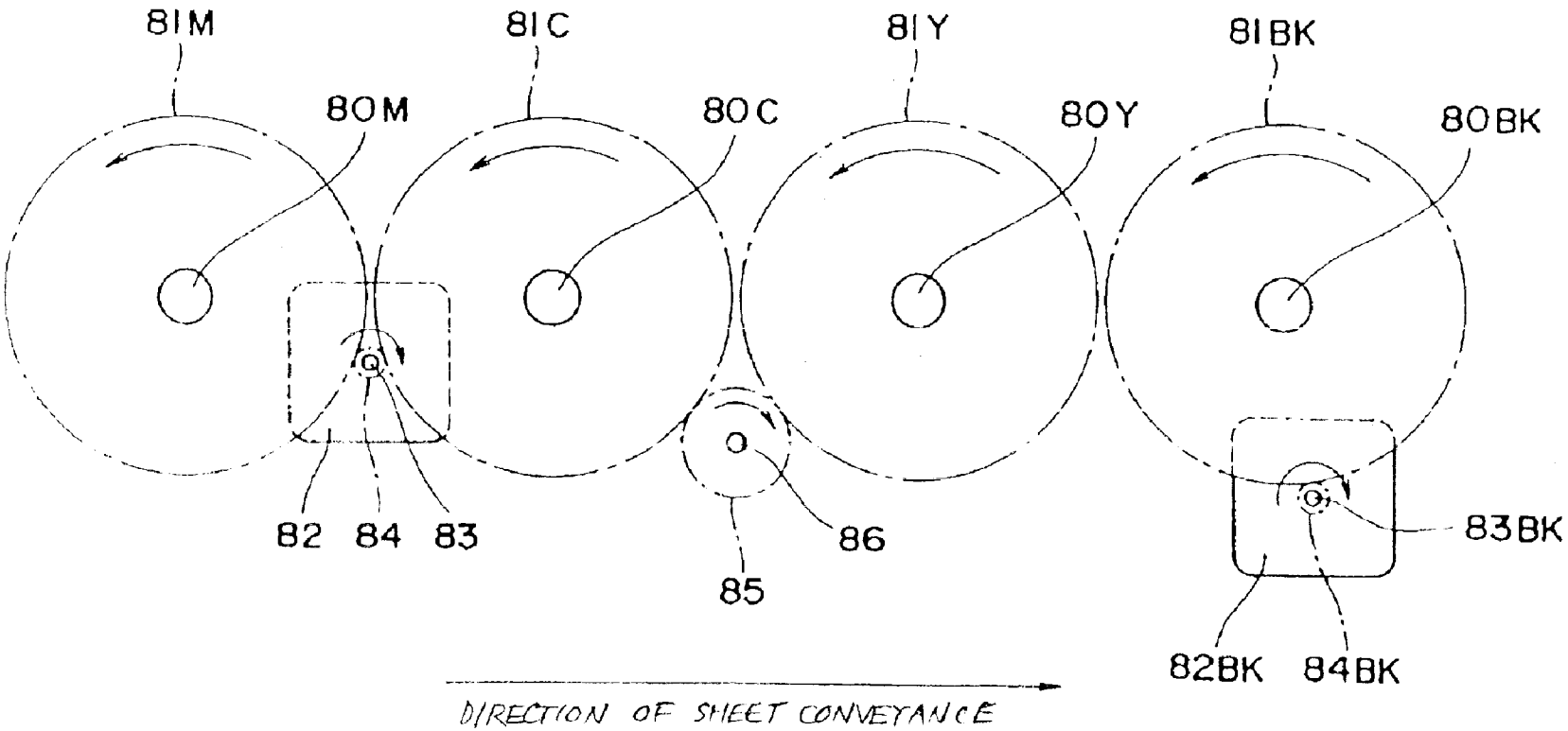
FIG. 4 shows a driving device included in the image forming device.

FIG. 4 shows a driving device for driving drums 40M through 40BK included in the image forming means 18M, 18C, 18Y and 18BK, respectively. Driving each of the four drums 40M through 40BK with an exclusive drive motor would increase the cost. In light of this, in the illustrative embodiment, the drum 40BK assigned to black and often used alone is driven by an exclusive drive motor 82BK while the other drums 40M, 40C and 40Y share a single drive motor 82.

More specifically, as shown in FIG. 4, drum gears or driven gears 81M, 81C, 81Y and 81BK are respectively mounted on the shafts 80M, 80C, 80Y and 80BK of the drums 40M, 40C, 40Y and 40BK. A drive gear 84BK is mounted on the output shaft 83BK of the drive motor 82BK and held in direct mesh with the drum gear 81BK, which is coaxial with the drum BK, without the intermediary of an idler gear, so that a minimum of irregularity occurs in the drive. A drive gear 84 is mounted on the output shaft 83 of the drive motor 82 and is held in direct mesh with the drum gears 81M and 81C, which are respectively coaxial with the drums 40M and 40C, without the intermediary of idler gears for the same purpose as the drive gear 94BK. The drum gear 81C is held in mesh with the drum gear 81Y, which is coaxial with the drum 40Y, via a single idler gear 85.

In the illustrative embodiment, the ends of the output shafts 84BK and 84 of the drive motors 82BK and 82 each are directly toothed to form the drive gear 84BK or 84. The drive gears 84BK and 84 each may, of course, be implemented as an independent gear mounted on the output shaft 83BK.

The drive motor 82BK causes the drum gear 81BK to rotate via the drive gear 84BK and thereby causes the drum 40BK to rotate counterclockwise, as viewed in FIG. 4. The other drive motor 82 causes the drum gears 81M and 81C to rotate via the drive gear 84 and thereby causes the drums 40M and 40C to rotate counterclockwise, as viewed in FIG. 4. The drum gear 81C, in turn, causes the drum gear 81Y to rotate counterclockwise, as viewed in FIG. 4, via the idler gear 85, so that the drum 40Y is caused to rotate counterclockwise. While the idler gear 85 is rotatably mounted on a stationary shaft 86, it may be supported by, e.g., a frame and rotated together with a rotary shaft.

The problem with the driving device shown in FIG. 4 is that eccentricity or irregularity in diameter of any one of the drums 40M through 40BK, drum gears 81M through 81BK and idler gear 85 aggravates irregularity in the rotation speed of the drums 40M through 40BK, resulting in banding or color shift. This is particularly true with the drum 40Y because the output torque of the drive motor 82 is transferred thereto by way of the drive gear 84, drum gear 81C, idler gear 85, and drum gear 81Y. To solve this problem, in the configuration shown in FIG. 4, the rotation speed of either one of the idle gear 85 and motor output shaft 83 is caused to vary at a period which is an integral multiple of the period of rotation speed variation of the other of the idle gear 85 and motor output shaft 83.

Figure 5:
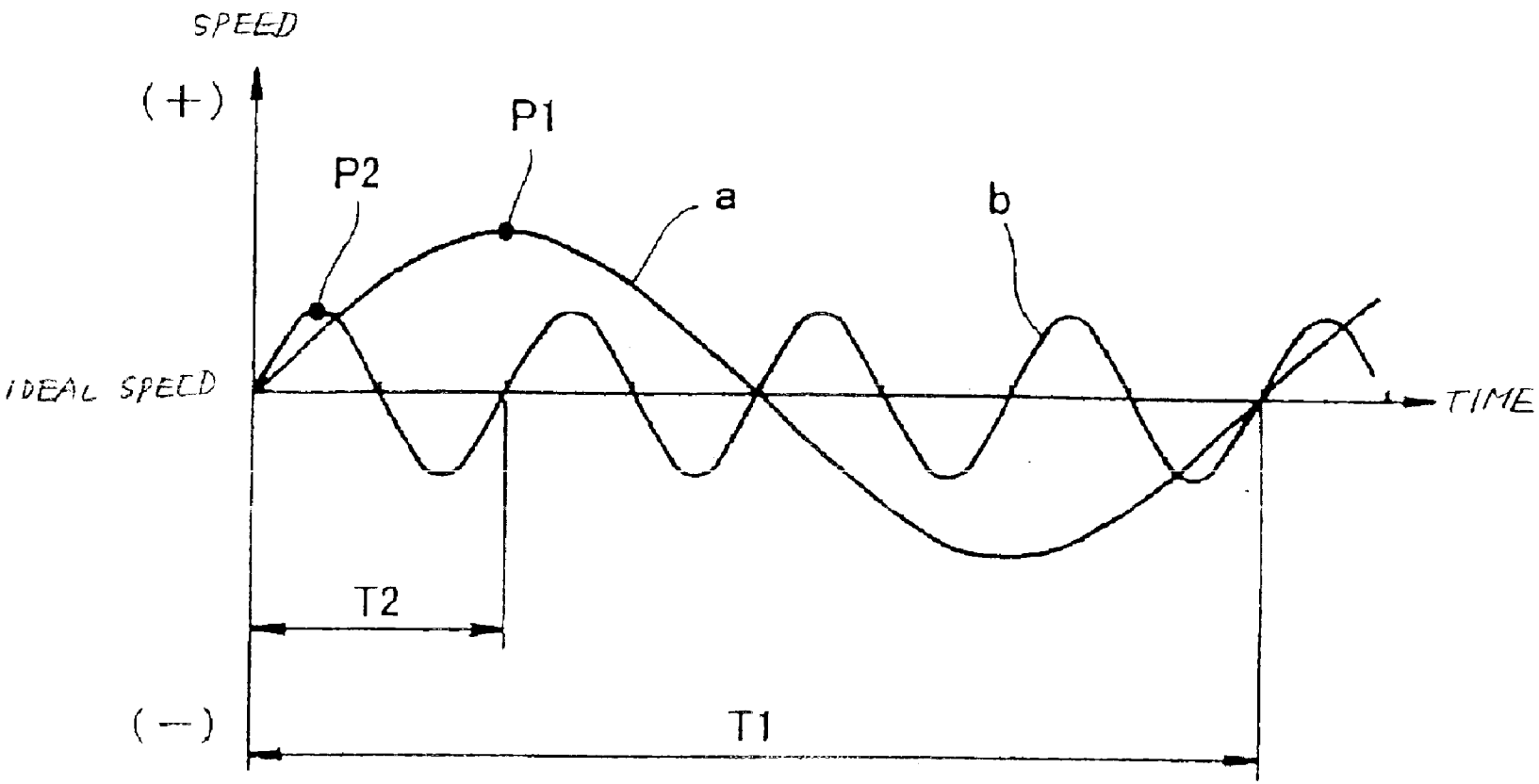
FIG. 5 shows curves respectively representative of the rotation speed variation of an idler gear and that of the output shaft of a drive motor included in the driving device on the assumption that the frequency of the former is four times as high as the frequency of the latter.

More specifically, FIG. 5 shows curves a and b respectively representative of the variation of the rotation speed of the idler gear 85 and that of the motor output shaft 83. As shown, the rotation speed of the idler gear 85 varies at a period of T1 while the rotation speed of the motor output shaft 82 varies at a period of T2. In the illustrative embodiment, the period T1 is selected to be, e.g., four times as long as the period T2. In this configuration, the drum gear 81Y can be rotated via the idler gear 85 in the same manner as the drum gear 81C without being effected by the variation of rotation speed ascribable to the eccentricity or the irregularity of diameter of the idler gear 85. This successfully reduces relative rotation speed between the drum gears 81Y and 81C with a simple, low cost arrangement, thereby reducing banding or positional shift.

The idler gear 85 and drive motor 82 are mounted such that the curves a and b have phases whose peaks P1 and P2, respectively, do not coincide with each other. Stated another way, the maximum drive irregularities P1 and P2 of the idler gear 85 and motor output shaft 83, respectively, are shifted from each other to thereby reduce the rotation speed variation of the drum gear 81Y as far as possible.

As shown in FIG. 6, the period T1 of rotation speed variation of the idler gear 85 may be three times as long as the period T2 of rotation speed variation of the motor output shaft. 82, if desired. Further, FIGS. 7 and 8 respectively show a case wherein the period T1 is two times as long as the period T2 and a case wherein the former is one time as long as the latter, i.e., the former and latter are equal to each other. The crux is that the period T1 is an integral multiple of the period T2.

Figure 8:
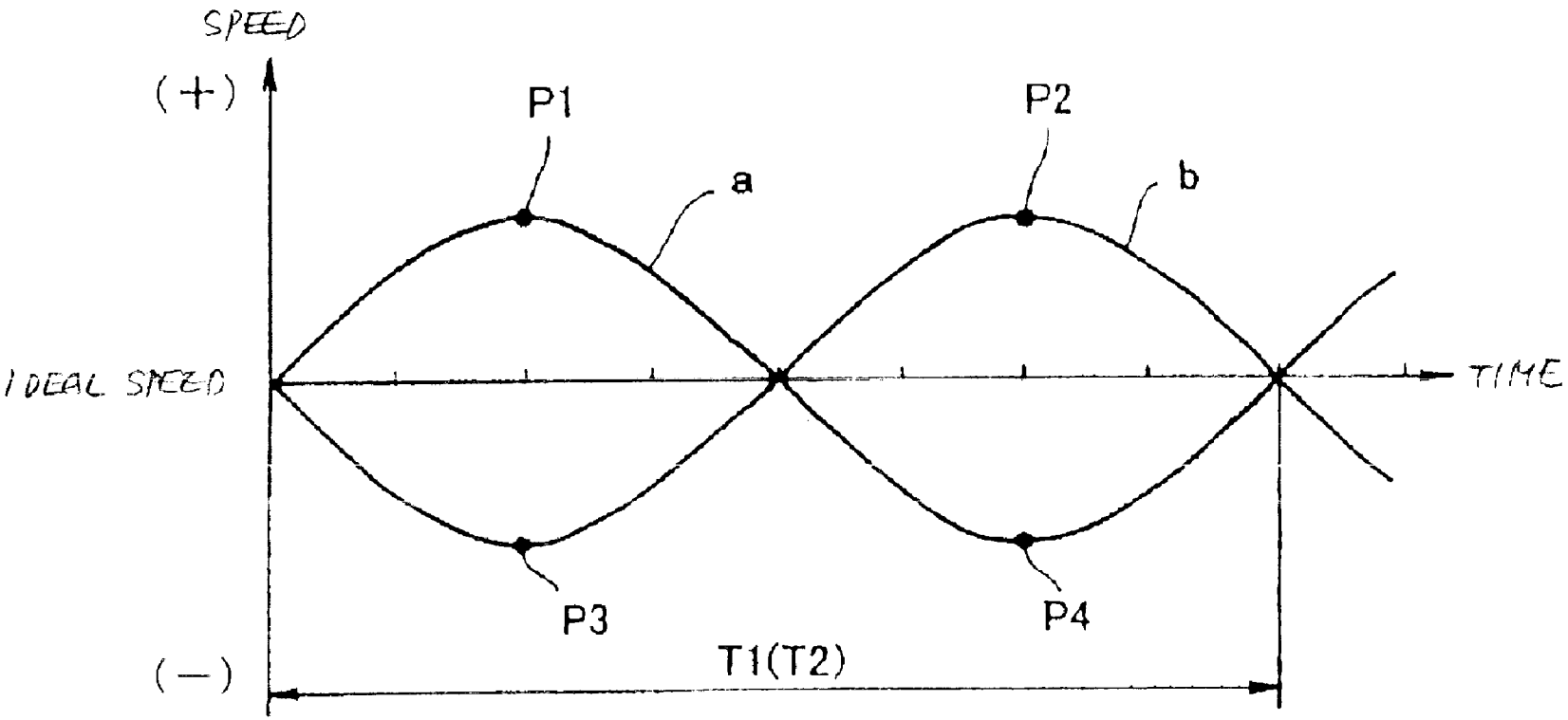
FIG. 8 also shows curves similar to the curves of FIG. 5 on the assumption that the frequency of rotation speed variation of the idler gear is equal to the frequency rotation speed variation of the motor output shaft.

When the period T1 is an odd multiple of the period T2, as shown in FIG. 6 or 8, the idler gear 85 and drive motor 82 are mounted such that the maximum value P1 and minimum value P4 of the curve a coincide in phase with the minimum value P3 and maximum value P2 of the curve b, respectively. This is successful to shift the maximum values P1 and P2 of irregularities of the idler gear 85 and motor output shaft 82, respectively, for thereby reducing the rotation speed variation of the drum gear 81Y as far as possible. Consequently, banding and positional shift can be reduced by a simple, low-cost configuration.

Further, when the period of rotation speed variation of one of the idler gear 85 and motor output shaft 83 is an odd multiple of the other, it is preferable to equalize the periods T1 and T2, as shown in FIG. 8. The periods T1 and T2 equal to each other reduce the rotation speed variation of the drum gear 81Y most and therefore make it possible to reduce banding and positional shift with a simple, low cost configuration.

Figure 7:
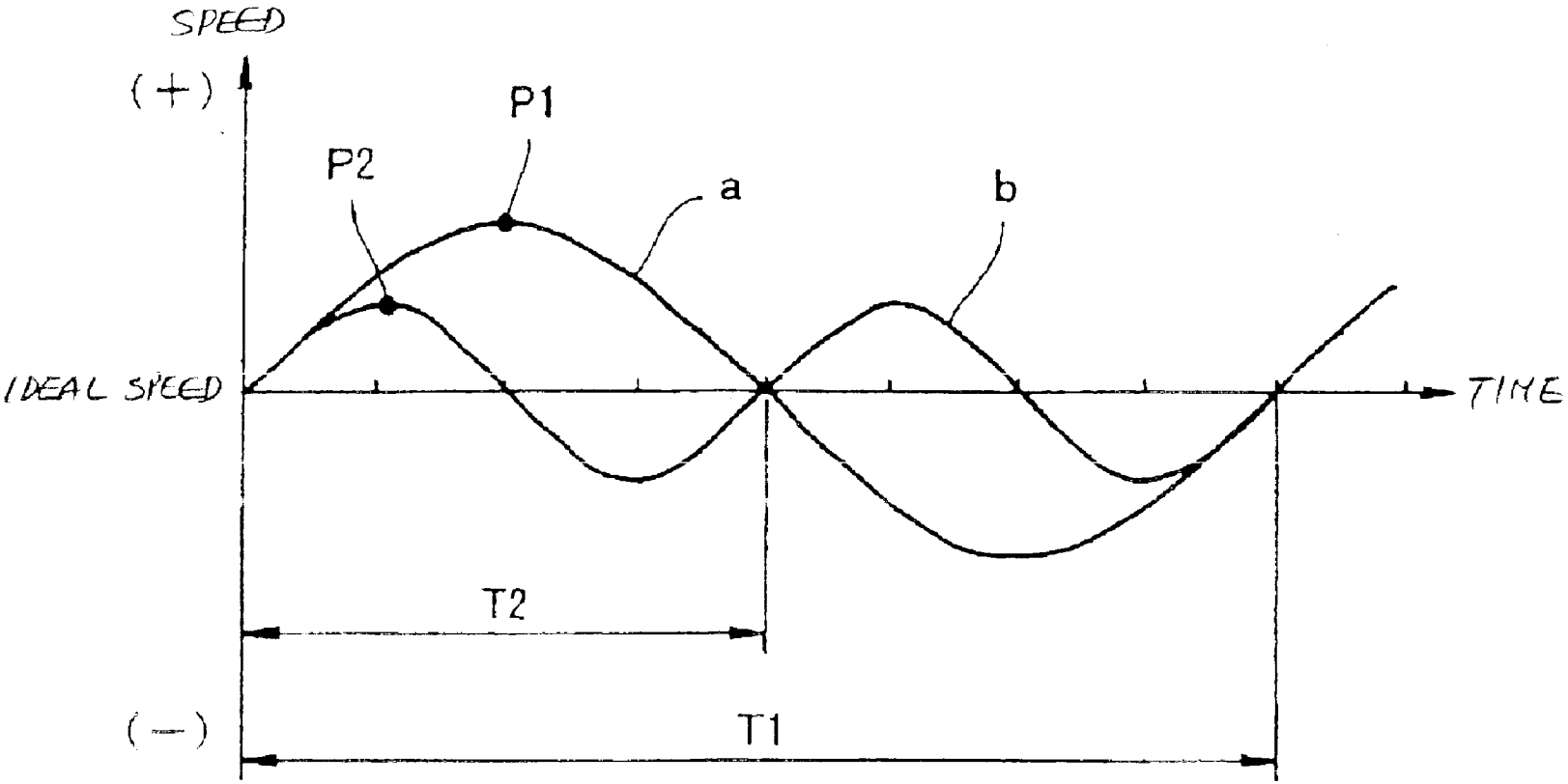
FIG. 7 also shows curves similar to the curves of FIG. 5 on the assumption that the frequency of rotation speed variation of the idler gear is two times as high as the frequency rotation speed variation of the motor output shaft.

When the period of rotation speed variation of one of the idler gear 85 and motor output shaft 83 is an even multiple of the other, as shown in FIG. 5 or 7, the idler gear 85 and drive motor 82 are mounted such that the zero points of the curves a and b coincide in phase with each other. This also reduces the rotation speed variation of the drum gear 81Y as far as possible for thereby reducing banding and positional shift with a simple, low-cost configuration.

Assume that the curves a and b relating to the idler gear 85 and motor output shaft 83, respectively, are represented by linear equations y=f(x) and y'=f(x'), respectively. Then, the idler gear 85 and drive motor 82 should preferably be mounted in such a phase that the maximum value of a composite linear equation $$y''=f(x'')=y+y'=f(x)+f(x')$$

is minimum. In this condition, the composite maximum value of the curves a and b is reduced. This also reduces the rotation speed variation of the drum gear 81Y as far as possible and makes it possible to reduce banding and positional shift with a simple, low cost configuration.

Further, a single gear 84 is held in direct mesh with the two drum gears 81M and 81C, so that a single drive motor 82 can drive both of the drums 40M and 40C. The rotation speed variations of the drums 40M and 40C can therefore be reduced as far as possible at low cost.

Moreover, the gear 84BK mounted on the output shaft 83BK of the drive motor 82BK is held in direct mesh with the drum gear 81BK. It follows that in a black-and-white mode, which is used more often than a full-color mode, only the drum 40BK is driven while the other drums 40M, 40C and 40Y are not driven. This successfully obviates wasteful power consumption and enhances durability.

In the illustrative embodiment, a period of time necessary for the drum 40Y to move from the write position A to the image transfer position B (see FIG. 2) is selected to be an integral multiple (e.g. four times) of the period of rotation speed variation of the idler gear 85. This obviates an occurrence that the image transfer position B. is shifted relative to the write position A due to the variation of the rotation speed of the drum 40Y; otherwise, image quality would be lowered.

While the drive motors 82BK and 82 are implemented as stepping motors in the illustrative embodiment, they may, of course, be implemented as DC motors or supersonic motors.

Figure 9:
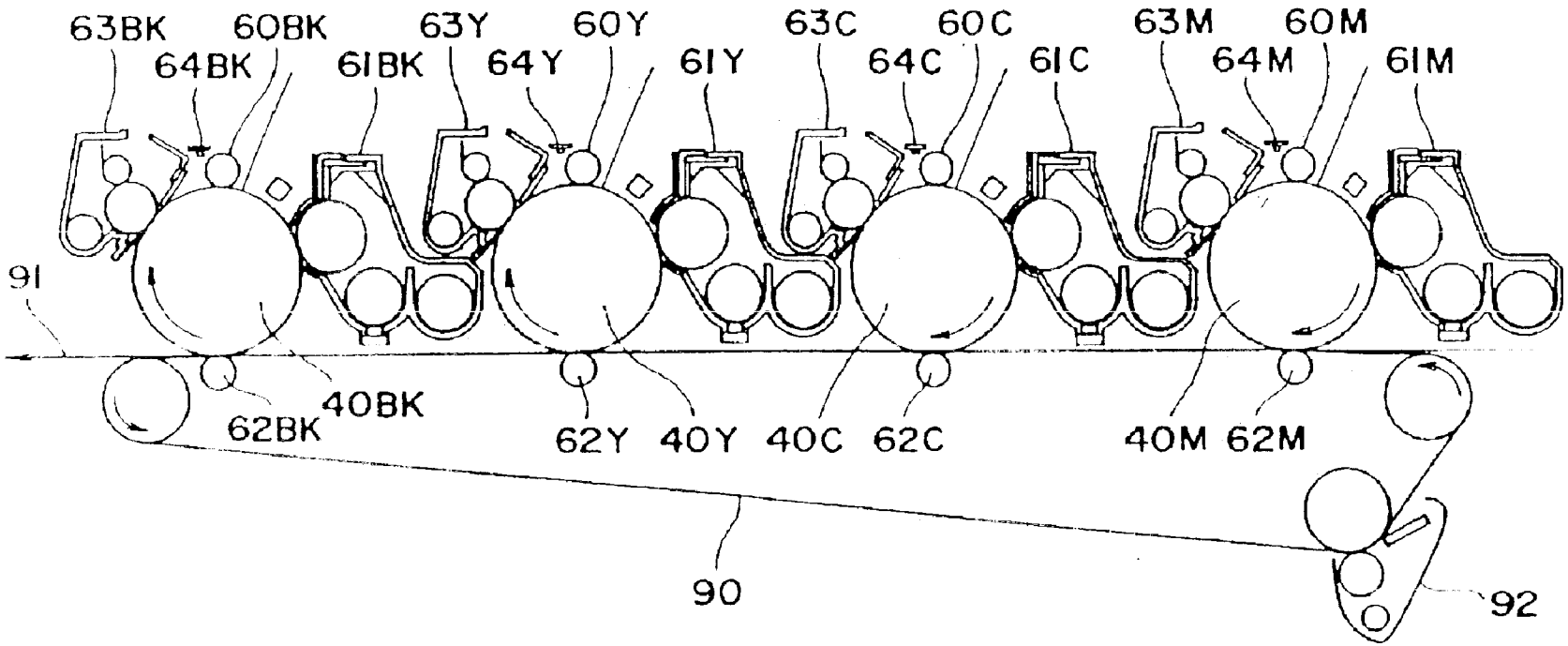
FIG. 9 shows a specific configuration of a color image forming apparatus to which the illustrative embodiment is applicable.

FIG. 9 shows another type of color image forming apparatus to which the illustrative embodiment is applicable. As shown, the color image forming apparatus is constructed such that toner images formed on the drums 40BK, 40Y, 40M and 40C are directly transferred to a sheet or similar recording medium 91 being conveyed by a belt 90, completing a full-color image on the sheet 91. The belt 90 is cleaned by a belt cleaner 92. The image forming apparatus also includes chargers 60M, 60C, 60Y and 60BK, developing units 61M, 61C, 61T and 61BK, primary image transferring devices 62M, 62C, 62Y and 62BK, drum cleaners 63M, 63C, 63Y and 63BK, and dischargers 64M, 64C, 64Y and 64BK.

Figure 10:
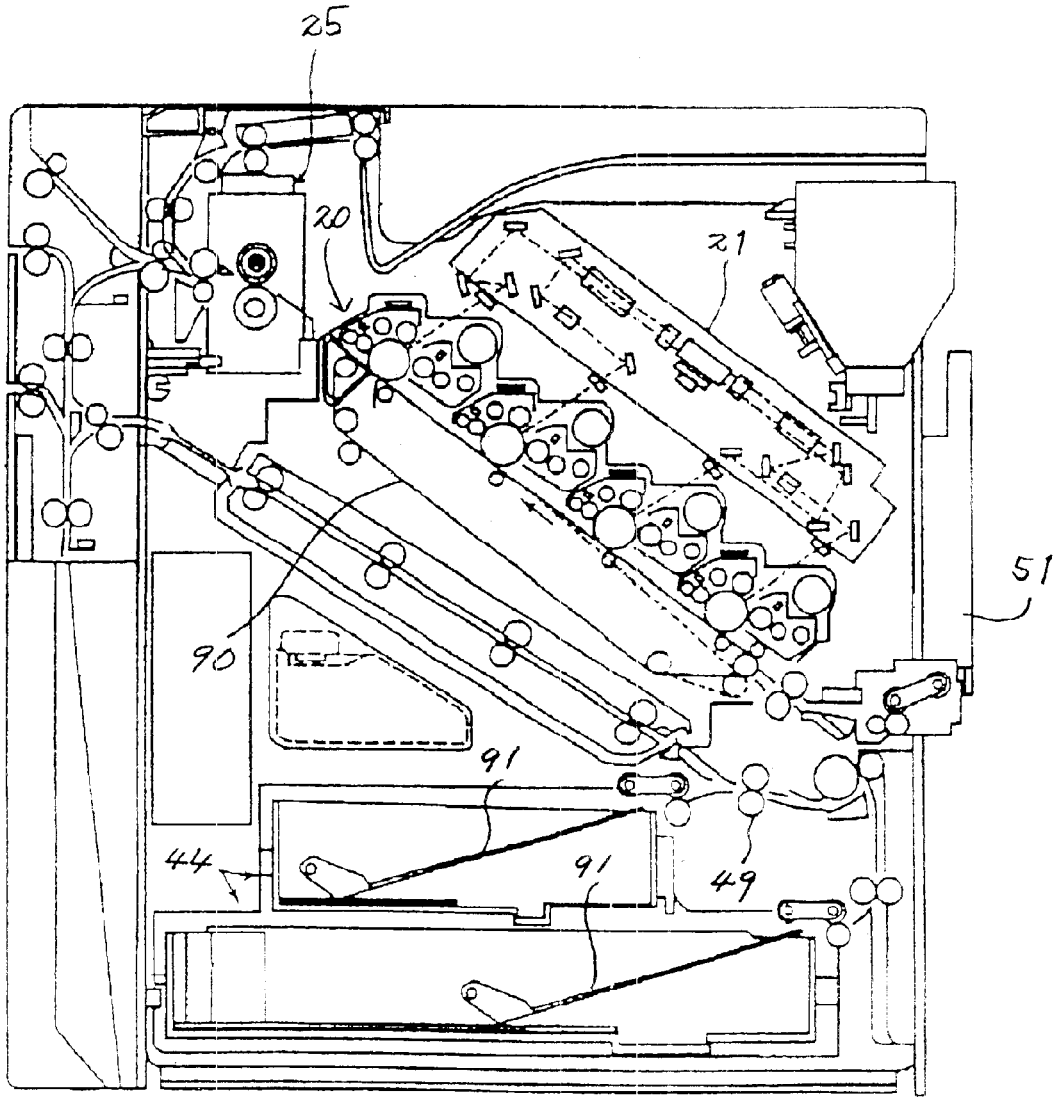
FIG. 10 shows an alternative embodiment of the present invention.

While the belt 90 is shown as extending substantially horizontally in FIG. 9, it may be inclined, as shown in FIG. 10 that illustrates an alternative embodiment of the present invention to be described later. In this configuration, toner images formed on the drums 40BK through 40C are also directly transferred to the sheet 91, completing a full-color image on the sheet 91.

In the illustrative embodiment, the period of rotation speed variation of the idler gear 85 is selected to be an integral multiple of the period T2 of rotation speed variation of the motor output shaft or drive source 83, the latter may be selected to be an integral multiple of the former, if desired.

It is to be noted that the drums or image carriers included in the color image forming apparatus are specific forms of rotary bodies. In addition, the rotary bodies are not limited to rotary bodies included in a color image forming apparatus.

As stated above, the illustrative embodiment can reduce relative rotation speed between a plurality of driven gears with a simple, low cost configuration, thereby reducing banding and color shift. Further, the. illustrative embodiment obviates wasteful rotation of rotary bodies to thereby save power and enhance durability. Moreover, the illustrative embodiment prevents image quality from being lowered due to the shift of the image transfer position relative to the write position ascribable to the variation of rotation of an image carrier.

Figure 11:
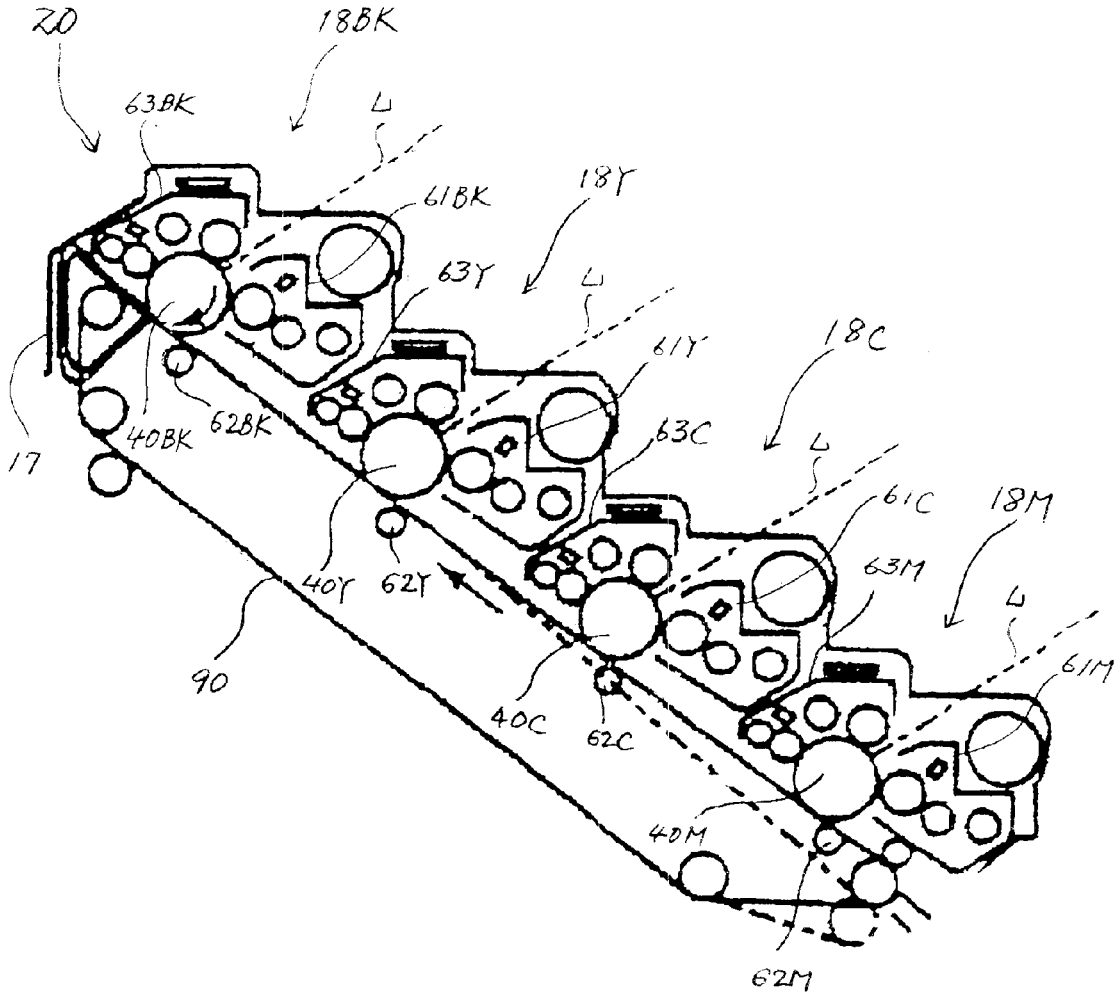
FIG. 11 is an enlarged view showing part of a tandem, image forming apparatus included in the alternative embodiment.

Reference will be made to FIGS. 10 and 11 for describing an alternative embodiment of the present invention. In FIGS. 10 and 11, structural elements identical with the structural elements of the previous embodiment are designated by identical reference numerals and will not be described specifically in order to avoid redundancy. Also, the construction and operation of the color copier shown in FIG. 10 and those of the tandem, image forming device 20 shown in FIG. 11 are substantially identical with the constructions and operations described with reference to FIGS. 1 through 3 and will not be described specifically for the same purpose.

As shown in FIGS. 10 and 11, the belt 90 faces the image forming means 18M through 18Bk of the tandem, image forming device 20 and is movable in a direction indicated by an arrow. In the illustrative embodiment, the upstream side of the belt 90 in the direction of movement, i.e., the side of the belt 90 in which a sheet enters is selectively movable into or out of contact with the image forming means 18M through 18Bk to a position indicated by a solid line or to a position indicated by a phantom line. When only a black image is to be formed on a sheet, only the image forming means 18BK assigned to black is caused to face the belt 90. The image forming device 20 additionally includes a charger for electrostatically retaining the sheet on the belt 90, and charges for electrostatically transferring toner images from the drums 40M through 40Bk to the sheet.

Figure 12:
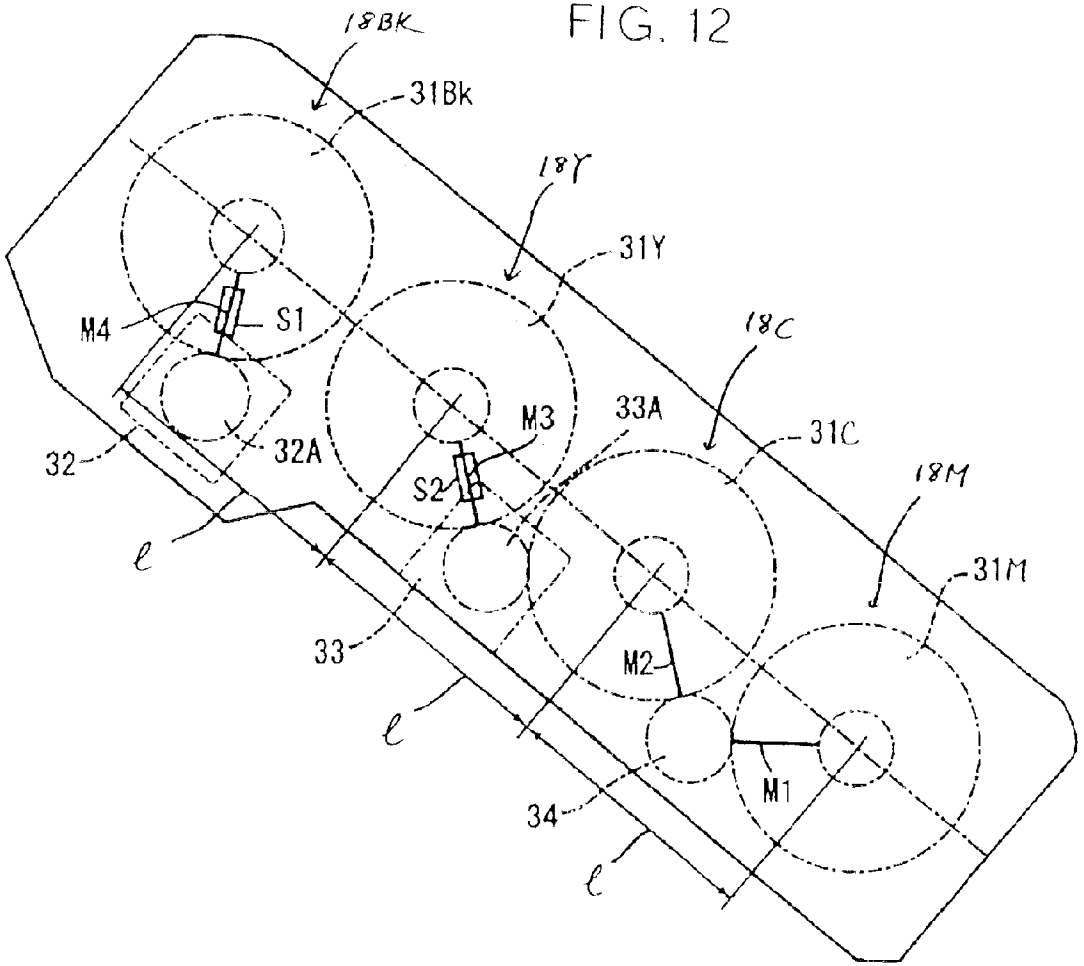
FIG. 12 shows a drive transmission mechanism included in the alternative embodiment.

FIG. 12 shows a driving device for driving the drums 40BK through 40M of the illustrative embodiment. As shown, gears 31BK, 31Y, 31C and 31M are respectively mounted on the shafts of the drums 40Bk, 40Y, 40C and 40M coaxially with the drums. The gears 31BK through 31M play the role of driven members for causing the drums 40BK through 40M to rotate. Nearby ones of the image forming means, i.e., drums are spaced by a distance 1.

Among the gears 31BK through 31M, the gear or one driven member 31BK associated with the drum 40Bk is driven by a gear 32A mounted on the output shaft of a stepping motor or drive source 32. The gear 32A is independent of the gears or other driven members associated with the drums 31Y, 31C and 31M. A gear 33A is mounted on the output shaft of, a stepping motor 33 and held in mesh with the gears or other driven members 31Y and 31C for thereby driving the gears 31Y and 31C. Further, the gear 31C of the drum 40C causes the gear 31M of the drum 40M to rotate via an idle gear 34.

The idle gear 34 is included in the drive transmission path to the gear 31Y of the drum 40Y assigned to yellow for the following reason. More gears exist on the drive transmission path to the gear 31Y than to the other gears 31M and 31C. In this respect, the idle gear 34 makes banding visually unnoticeable when it occurs due to an error in one pitch of every gear. More specifically, although a mass inertial body may be used to obviate the above banding, as taught in Japanese Patent Laid-Open Publication No. 6-167858 stated earlier, such a member renders the construction sophisticated and increases the load on rotation and therefore energy loss. In the illustrative embodiment, the idle gear 34 is assigned to yellow, which is visually less conspicuous than the other colors as to banding, for thereby reducing the influence of the idle gear 34.

The gears 31M, 31C and 31Y, which are driven members other than the one driven member, are mounted such that the image transfer positions of the associated drums 40M, 40C and 40Y are coincident. More specifically, the gears 31M, 31C and 31Y are respectively provided with marks M1, M2 and M3 indicative of the peaks of eccentricity and are sequentially mounted such that the periods of eccentricity components of nearby gears are coincident. That is, after the first gear has been mounted, the second gear next to the first gear is mounted with its marking positioned in the circumferential direction such that the period of its eccentricity component coincides with that of the first gear, and then the third gear is mounted with its marking positioned such that the period of its eccentricity component coincides with that of the second gear. By such a procedure, the period of variation to occur during rotation is uniformed in phase throughout the gears 31M through 31Y, obviating the shift of image transfer position.

Figure 13:
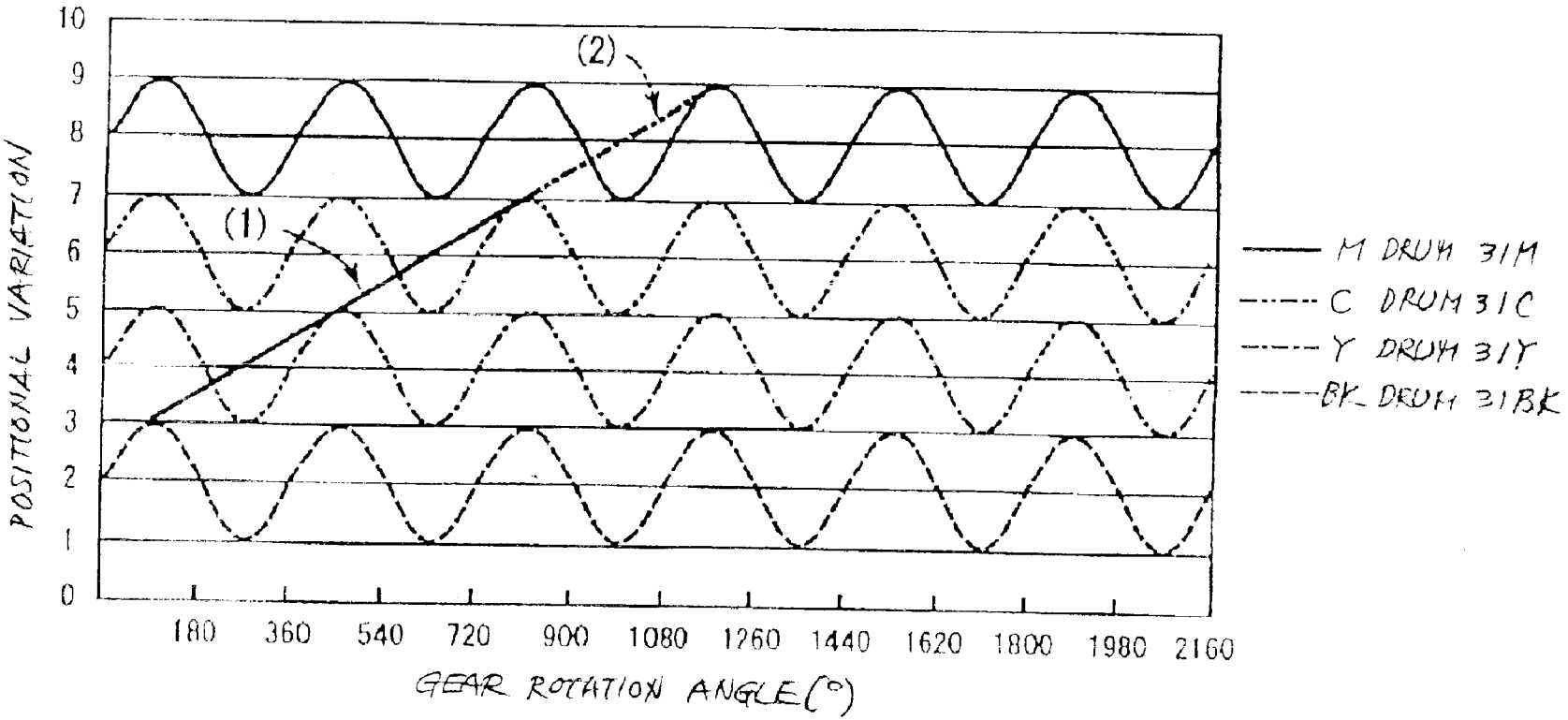
FIG. 13 time-serially shows the phases of rotation speed variations to occur in the drive transmission mechanism of FIG. 12.

FIG. 13 time-serially shows phases in which the rotation variations of the drums with the markings occur. As shown, so long as the distances 1 (=πD where D denotes the outside diameter of each drum) between nearby drums are equal, toner images can be transferred from the magenta, cyan and yellow drums at a timing indicated by a line (1). Stated another way, toner images are transferred at a timing at which the phase level is the same throughout the rotation variations of such drums, so that the shift of the image transfer position and color shift can be obviated.

As stated above, in the illustrative embodiment, when a black image is to be formed, only the stepping motor or drive source 32 exclusively assigned to the black drum should be driven, i.e., the other drums do not have to be driven. This not only reduces the load on drive, but also promotes high-speed image formation.

When the drums other than the black drum are collectively driven by the shared stepping motor 33, images can be transferred at the timing at which the variation phases of the drums are coincident, because the phases of rotation variations of the gears are coincident. This reduces banding and thereby reduces color shift and image shift that would bring about defective images.

As for banding, the yellow drum 40Y is located at a position to which drive is transmitted via the idle gear 34, so that banding, if occurred, is visually unnoticeable. A full-color image is therefore free from noticeable color shift.

A modification of the illustrative embodiment will be described hereinafter. The modification is configured to obviate image shift when the drum assigned to black is driven in addition to the other drums assigned to magenta, cyan and yellow. More specifically, as shown in FIG. 12, the gear or one driven member 31Bk coaxial with the drum 40Bk is provided with a marking M4 like the gear 31Y of the drum 40Y next to the drum 40Bk. The marking M4, like the other markings, is positioned at the peak of the period of the eccentricity component.

Sensors S1 and S2 are respectively responsive to the markings M4 and M3 provided on the gears 31Bk and 31Y, so that the angular positions of the gears 31BK and 31Y can be determined. The sensors S1 and S2 are implemented as reflection type sensors and used to uniform in phase the rotation variations of all of the drums 31Bk through 31M. More specifically, after the sensor S1 has sensed the marking M4 of the gear 31Bk coaxial with the drum 40Bk, the angular position of the gear 31Bk is adjusted such that the marking M4 is sensed at the same timing as the marking M3 of the gear 31Y. The rotation variation of the gear 31Y is coincident in phase with the rotation variations of the gears 31C and 31M, as stated earlier. Therefore, only if the rotation variation of the gear 31Y and that of the gear 31Bk are matched in phase, the gears 31Bk through 31M all are brought into coincident in phase, as indicated by the line (2) in FIG. 13. It follows that in a full color mode only if the angular position of the gear 31Bk is determined, the image transfer timing can be set drum by drum so as to obviate image shift.

Another modification of the illustrative embodiment will be described hereinafter. Briefly, this modification is configured to match the number of teeth of the gear associated with the drive source and that of the idle gear, thereby establishing the same image transfer timing throughout the drums. More specifically, in FIG. 12, the gear 32A of the stepping motor 32 and the gear 31Bk of the drum 40Bk meshing with each other are provided with the same number of teeth. This is also true with the gear 33A of the stepping motor 33 and the idle gear 34 meshing with each other. Such a relation allows rotation frequencies to coincide with each other.

Further, the gears 31M through 31Bk have an outside diameter which is an integral multiple of the outside diameter of the gears 32A, 33A and 34. In the specific modification, the gear ratio of each drum gear to the associated gear or idler gear at the drive source side is selected to be 6:1.

The gears 32A, 33A and 34 located at the drive source side or idler gears each are provided with a marking at the its eccentricity peak position like the drum gears. A particular reflection type sensor is assigned to each of the gears 32A, 33A and 34 for sensing the marking.

Figure 14:
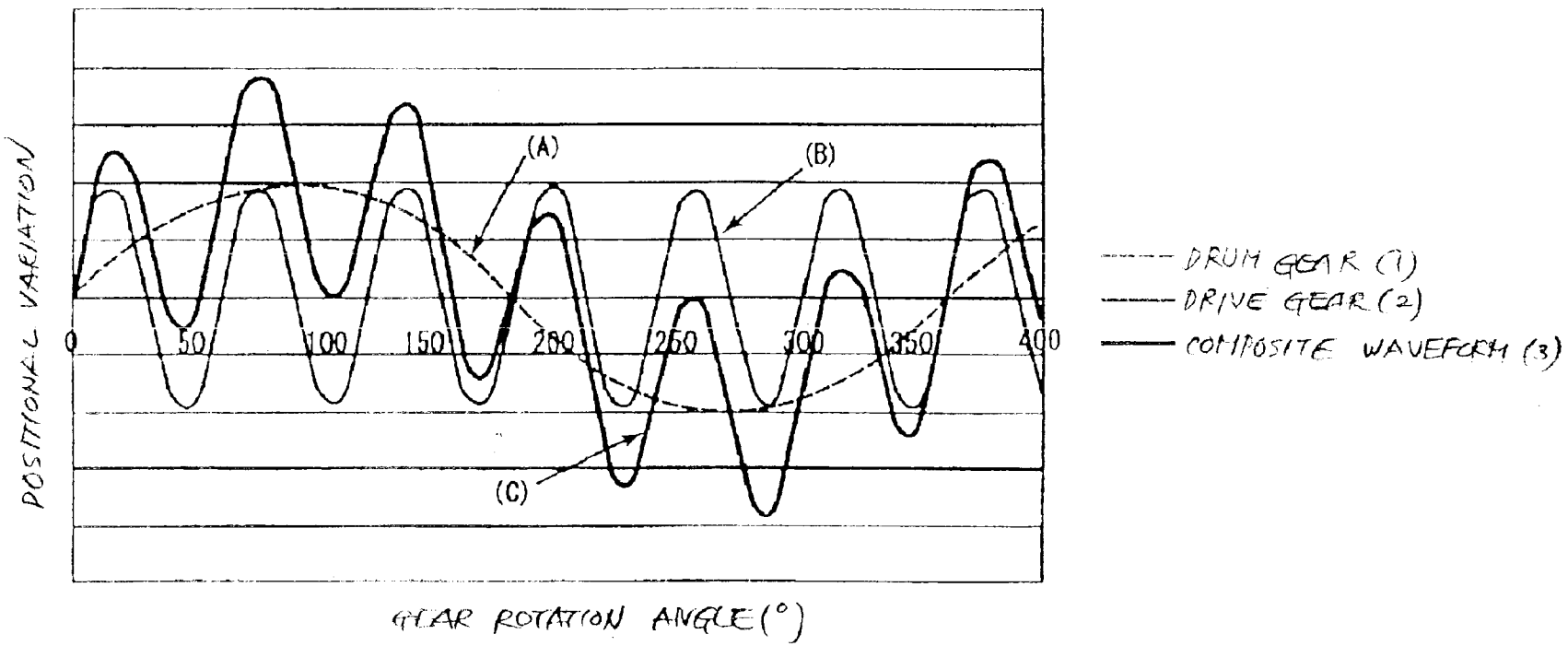
FIG. 14 time-serially shows the phase of rotation speed variation as to a single photoconductive element.

FIG. 14 time-serially shows the phase of rotation variation of one drum gear and that of one gear located at the drive source side or idler gear. As shown, the variation of the drum gear varies in a phase represented by a curve (A) while the variation of the gear at the drive source side or idler gear varies in a phase (B) A phase (C) is the composite phase of the phase components (A) and (B) and representative of the variation phase of the drum.

In the illustrative embodiment, by matching the numbers of teeth of the gears at the drive source side or idler gears, it is possible to match the rotation frequencies. Therefore, the gears can be mounted such that their rotation variation periods coincide with each other. More specifically, the markings are sensed to adjust the angular positions of the gears such that the rotation variation phases of the gears coincide with each other, as described with reference to FIG. 13. In this case, too, angular positions are adjusted such that the markings of the drum gears and those of the gears at the drive source side or idler gears are sensed at the same timing.

Figure 15:
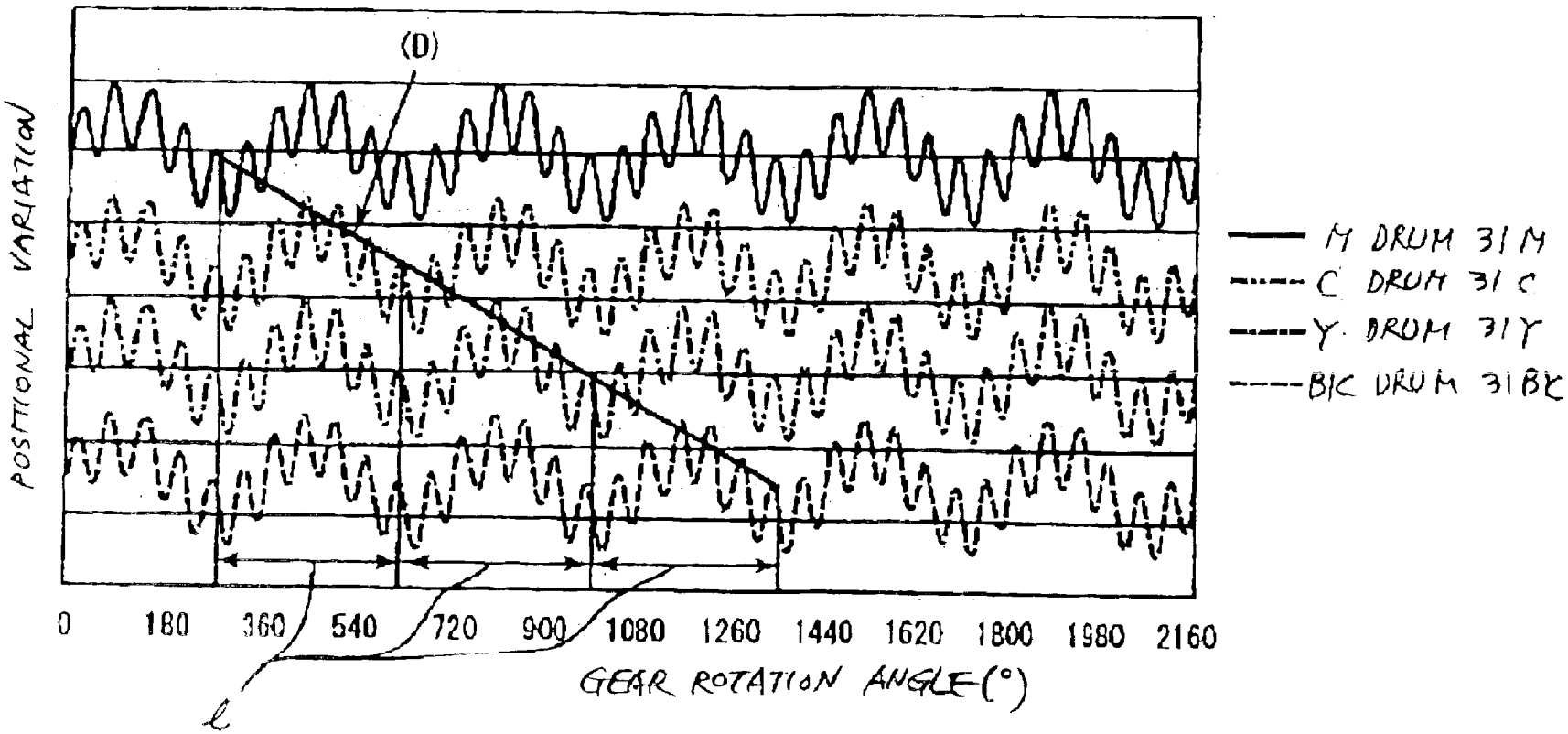
FIG. 15 time-serially shows the phases of rotation speed variations each being based on the phase of FIG. 14.

FIG. 15 time-serially shows the rotation variation phases of all of the drums each being based on the rotation variation phase of FIG. 14. As shown, if the distance 1 between nearby image forming means is equal to the circumferential length of each drum, then the positions where the rotation variation phases of the drums are identical are set as image transfer timings, as indicated by a line (D). Therefore, a difference in rotation variation phase between the drum gears and the gears at the drive source side or idler gears is obviated, so that a difference in image transfer position between the drums is minimized. It follows that images can be transferred one above the other with a minimum of color shift even when gears are arranged in a plurality of stages.

Assume that the distance 1 between nearby drums is not equal to the circumferential length of each drum. Then, the position where the gear at the drive source side or idler gear and the drum gear start meshing with each other should only be shifted in matching relation to the difference between the distance 1 and the circumferential length of each drum.

As stated above, the illustrative embodiment saves a driving force and therefore cost and energy while obviating color shift or similar image defect. Further, the illustrative embodiment is capable of matching the phases of rotation variations of a plurality of driven members by simple control. Moreover, the illustrative embodiment minimizes a difference in image transfer position between drums, thereby reducing color shift even when gears are arranged in a plurality of stages.

Various modifications will become possible for those skilled in the art after receiving the teachings of the present disclosure without departing from the scope thereof.

What is claimed is:

1. A driving device for driving a plurality of driven members, said driving device comprising:

a first drive source for driving, among the plurality of driven members, a first driven member;

a second drive source for driving second driven members other than the first driven member; and an idler gear intervening between the second driven members for transmitting an output torque of said second drive source;

wherein the second driven members are matched in rotation variation phase to each other during assembly.

2. The driving device as claimed in claim 1, wherein said first drive source and said second drive source each comprise a respective drive gear while the first driven member and the second driven members each comprise a respective gear.

3. The driving device as claimed in claim 2, wherein a particular rotation position sensor is assigned to each of the gear of the first driven member and one of the gears of the second driven members, and the gear of said first driven member and said one of the gears of the second driven member are matched in rotation variation phase to each other.

4. The driving device as claimed in claim 1, wherein said first drive source and said second drive source each comprise a respective drive gear, said respective drive gear and a gear constituting said idler gear have a same number of teeth; and said respective drive gear and said gear constituting said idler gear are matched in rotation variation phase to each other and then matched in rotation variation phase to the gear of the first driven member or the gears of the second driven members.

5. In an image forming apparatus including a driving device configured to drive a plurality of driven members, said driving device comprising:

a first drive source for driving, among the plurality of driven members, a first driven member;

a second drive source for driving second driven members other than the first driven member; and an idler gear intervening between the second driven members for transmitting an output torque of said second drive source;

wherein the second driven members are matched in rotation variation phase to each other during assembly.

6. The apparatus as claimed in claim 5, wherein a gear constituting the first driven gear is mounted on a shaft of a photoconductive element capable of forming a black image, gears constituting the second driven members each are mounted on a shaft of one of photoconductive elements capable of forming a cyan, a magenta and a yellow image, respectively, the photoconductive elements capable of respectively forming the cyan image and the toner image both are driven by a drive motor for a color image independent of a drive motor exclusively assigned to the photoconductive element capable of forming the black image, and the photoconductive element capable of forming the cyan image is driven via said idler gear capable of being interlocked to the photoconductive elements driven by the drive motor for color.

7. The apparatus as claimed in claim 5, wherein said first drive source and said second drive source each comprise a respective drive gear while the first driven member and the second driven members each comprise a respective gear.

8. The apparatus as claimed in claim 7, wherein a particular rotation position sensor is assigned to each of the gear of the first driven member and one of the gears of the second driven members, and said gear of said first driven member and said one of said gears of said second driven member are matched in rotation variation phase to each other.

9. The apparatus as claimed in claim 5, wherein said first drive source and said second drive source each comprise a respective drive gear, said respective drive gear and a gear constituting said idler gear have a same number of teeth; and said respective drive gear and said gear constituting said idler gear are matched in rotation variation phase to each other and then matched in rotation variation phase to the gear of the first driven member or the gears of the second driven members.

10. A driving device for driving a plurality of rotary bodies, said driving device comprising:

a plurality of driven gears respectively coaxially mounted on the plurality of rotary bodies;

a drive gear mounted on an output shaft of a drive source and held in direct mesh with any one of said plurality of driven gears; and an idler gear meshing between the one driven gear directly meshing with said drive gear and another driven gear;

wherein a period of rotation speed variation of either one of said idler gear and the output shaft of said drive source is selected to be an integral multiple of a period of rotation variation of the other of said idler gear and said output shaft.

11. The driving device as claimed in claim 10, wherein said idler gear and said drive source are mounted such that curves respectively representative of the rotation speed variation of said idler gear and the rotation speed variation of the output shaft of said drive source have respective phases not coinciding in maximum value with each other.

12. A driving device for driving a plurality of rotary bodies, said driving device comprising:

a plurality of driven gears respectively coaxially mounted on the plurality of rotary bodies;

a drive gear mounted on an output shaft of a drive source and held in direct mesh with any one of said plurality of driven gears; and an idler gear intervening between the one driven gear directly meshing with said drive gear and another driven gear;

wherein a period of rotation speed variation of either one of said idler gear and the output shaft of said drive source is selected to be an integral multiple of a period of rotation variation of the other of said idler gear and said output shaft, said idler gear and said drive source are mounted such that curves respectively representative of the rotation speed variation of said idler gear and the rotation speed variation of the output shaft of said drive source have respective phases not coinciding in maximum value with each other, and when one of the periods of rotation variation of said idler gear and the output shaft of said drive source is an odd multiple of the other, said idler gear and said drive source are mounted such that a maximum value of one of said curves and a minimum value of the other curve coincide in phase with each other.

13. The driving device as claimed in claim 12, wherein the periods of rotation speed variation of said idler gear and the output shaft of said drive source are identical with each other.

14. The driving device as claimed in claim 10, wherein when one of the periods of rotation variation of said idler gear and the output shaft of said drive source is an even multiple of the other, said idler gear and said drive source are mounted such that zero points of said curves coincide in phase with each other.

15. The driving device as claimed in claim 10, wherein said idler gear and said drive source are mounted such that said curves are provided with a phase that minimizes a maximum value of a composite linear equation of said curves.

16. The driving device as claimed in claim 10, wherein said drive gear is held in direct mesh with two of said plurality of driven gears.

17. The driving device as claimed in claim 16, wherein a drive gear mounted on an output shaft of another drive source is held in direct mesh with another one of said plurality of driven gears.

18. In an image forming apparatus including a driving device configured to drive a plurality of rotary bodies, said driving device comprising:

a plurality of driven gears respectively coaxially mounted on the plurality of rotary bodies;

a drive gear mounted on an output shaft of a drive source and held in direct mesh with any one of said plurality of driven gears; and an idler gear meshing between the one driven gear directly meshing with said drive gear and another driven gear;

wherein a period of rotation speed variation of either one of said idler gear and the output shaft of said drive source is selected to be an integral multiple of a period of rotation variation of the other of said idler gear and said output shaft.

19. The apparatus device as claimed in claim 18, wherein said idler gear and said drive source are mounted such that curves respectively representative of the rotation speed variation of said idler gear and the rotation speed variation of the output shaft of said drive source have respective phases not coinciding in maximum value with each other.

20. In an image forming apparatus including a driving device configured to drive a plurality of rotary bodies, said driving device comprising:

a plurality of driven gears respectively coaxially mounted on the plurality of rotary bodies;

a drive gear mounted on an output shaft of a drive source and held in direct mesh with any one of said plurality of driven gears; and an idler gear intervening between the one driven gear directly meshing with said drive gear and another driven gear;

wherein a period of rotation speed variation of either one of said idler gear and the output shaft of said drive source is selected to be an integral multiple of a period of rotation variation of the other of said idler gear and said output shaft, said idler gear and said drive source are mounted such that curves respectively representative of the rotation speed variation of said idler gear and the rotation speed variation of the output shaft of said drive source have respective phases not coinciding in maximum value with each other, and when one of the periods of rotation variation of said idler gear and the output shaft of said drive source is an odd multiple of the other, said idler gear and said drive source are mounted such that a maximum value of one of said curves and a minimum value of the other curve coincide in phase with each other.

21. The apparatus as claimed in claim 20, wherein the periods of rotation speed variation of said idler gear and the output shaft of said drive source are identical with each other.

22. The apparatus as claimed in claim 18, wherein when one of the periods of rotation variation of said idler gear and the output shaft of said drive source is an even multiple of the other, said idler gear and said drive source are mounted such that zero points of said curves coincide in phase with each other.

23. The apparatus as claimed in claim 18, wherein said idler gear and said drive source are mounted such that said curves are provided with a phase that minimizes a maximum value of a composite linear equation of said curves.

24. The apparatus as claimed in claim 18, wherein said drive gear is held in direct mesh with two of said plurality of driven gears.

25. The apparatus as claimed in claim 24, wherein a drive gear mounted on an output shaft of another drive source is held in direct mesh with another one of said plurality of driven gears.

26. An image forming apparatus comprising:

a plurality of image carriers configured such that image data is written on each of said plurality of image carriers at a particular write position for forming a latent image, said latent image is developed to produce a corresponding toner image, and said toner image is transferred to a sheet at a preselected image transfer position; and a driving device comprising a driven gear coaxially mounted on each of said plurality of image carriers, a drive gear mounted on an output shaft of a drive source and held in direct mesh with said driven gear, and an idler gear via which said driven gear meshing with said drive gear is connected to a driven gear of another image carrier;

wherein a period of time necessary for said image carrier to move from the write position to the image transfer position is selected to be an integral multiple of a period of rotation speed variation of said idler gear.

* * * * *